United States Patent [19]

Ingwersen

[11] Patent Number: 4,614,143

[45] Date of Patent: Sep. 30, 1986

[54] APPARATUS FOR PROVIDING COMMONING CONNECTORS

[75] Inventor: Peter Ingwersen, Cary, Ill.

[73] Assignee: Molex Incorporated, Lisle, Ill.

[21] Appl. No.: 778,091

[22] Filed: Sep. 20, 1985

[51] Int. Cl.[4] ..... B26D 7/06

[52] U.S. Cl. ..... 83/622

[58] Field of Search ..... 83/620, 622, 697

[56] References Cited

U.S. PATENT DOCUMENTS

| | | | |
|---|---|---|---|
| 3,277,764 | 10/1966 | Henc | 83/697 X |
| 3,610,492 | 10/1971 | Bourgeois | 83/622 X |
| 3,938,413 | 2/1976 | Goettel et al. | 83/622 X |

*Primary Examiner*—Horace M. Culver

*Attorney, Agent, or Firm*—Louis A. Hecht

[57] ABSTRACT

Disclosed is an apparatus for severing connector sticks into separate connector modules. A stick is formed by arranging individual connector housings in a serial row, and joining the connectors by a pair of L-shaped carriers. The carriers are arranged to overlie an outside corner of each housing, with one leg of the L-overlying a sidewall, and the other leg of the L-overlying the bottom wall. A tool bit is provided with first and second cutting surfaces, which sever respective legs of the carrier. The tool bit is configured to be received between individual connector housings, to provide alignment with the legs of the carrier member. The tool bit is arranged to sever a substantial portion of one carrier leg, and to thereafter sever both carrier leg portions.

A method for severing the connector stick is also disclosed. According to the method, a substantial portion of the first carrier member is severed first, and the first and second carrier legs are thereafter simultaneously severed.

4 Claims, 8 Drawing Figures

APPARATUS FOR PROVIDING COMMONING CONNECTORS

BACKGROUND OF THE INVENTION

1. Field of the Invention

The present invention pertains to apparatus for providing commoning connectors which electrically common or shunt adjacent electrical terminals.

2. Brief Description of the Prior Art

One of the prominent concerns in electronics manufactured today is the space savings with which components can be provided on the printed circuit board. Further, with increased component density the need for making a greater number of connections at a given point on the circuit board, is becoming apparent. The commonly owned U.S. patent application Ser. No. 725,075 filed Apr. 19, 1985 discloses a commoning connector which meets these needs. Advantageous techniques for manufacturing, packaging, and storing these connectors in a fashion which is compatible with full automation technology is desired.

One advantageous arrangement of handling modular connector housings is disclosed in U.S. Pat. No. 4,492,023 which relates to a method and apparatus for fabricating an electrical harness. The connector housings illustrated therein are integrally molded in a single row. The housings are connected together by means of selectively removeable web or connecting members. In this arrangement, the individual housings are not intended to remain joined together for mating with a plurality of corresponding pin-like terminals. Arrangements for providing arrays of such connectors, which may be simultaneously employed with varying circuit sizes is desireable.

SUMMARY OF THE INVENTION

It is therefore an object of the present invention to provide a method and apparatus for separating predetermined portions of a connector assembly having an integrally molded housing structures joined by a commond web-like carrier member. These and other objects of the present invention are provided in a method of separating a rigid integrally molded dielectric connector assembly having a plurality of spaced-apart connector housings with first and second adjacent walls forming an outside corner, first and second carrier members joining the respective first and second walls of adjacent housings together at said corners, and tool receiving recesses formed between adjacent housings. The method comprises providing a tool bit having first and second cutting surfaces, inserting the tool bit in the recesses for sliding advancement toward said first carrier member, severing a substantial portion of said first carrier member located remote from said corner, thereafter simultaneously severing both said first and second carrier members until they are removed from between adjacent housings.

The objects of the present invention are also provided in an arrangement for providing a plurality of connector housings including a rigid integrally molded dielectric connector stick having a plurality of spaced-apart housings joined together by at least one carrier member, and cutting means for severing said carrier member from said stick to form said housings. The improvement comprises a stick including a plurality of spaced-apart connector housings having first and second adjacent walls forming an outside corner, first and second carrier members joining the respective first and second walls of adjacent connectors together at said corners, and tool receiving recesses formed between adjacent connectors, the cutting means comprising a tool bit having first and second cutting surfaces, slidingly receivable in said recesses such that, upon advancement toward said carrier members, the first carrier member is first severed at points remote from the corner, and both the first and second carrier members are thereafter simultaneously severed until they are removed from between adjacent housings, and means for advancing said tool bit cutting surfaces towards said carrier members.

BRIEF DESCRIPTION OF THE DRAWINGS

In the drawings, wherein like elements are referenced alike.

DETAILED DESCRIPTION OF THE PREFERRED EMBODIMENT

Figure 1:
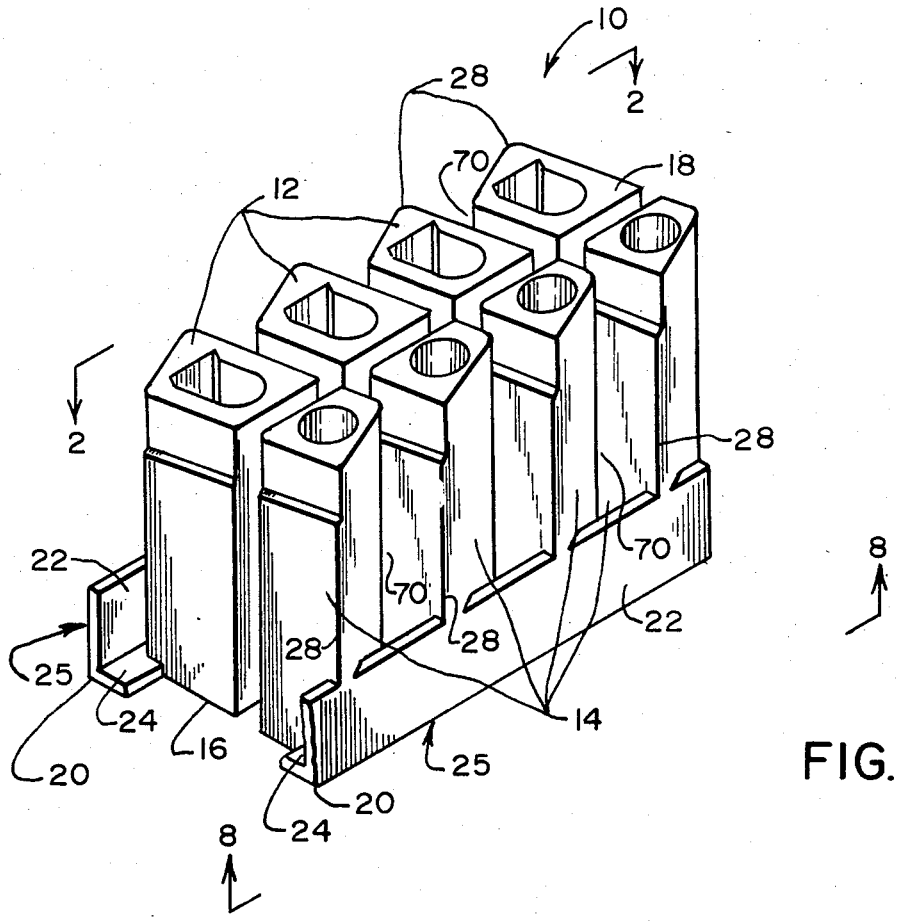
FIG. 1 is a perspective view of a connector stick, showing the web-like carrier members joining the connector housings in an integral molding subassembly.

FIG. 1 shows a connector assembly, commonly referred to as a connector stick, of the type disclosed in commonly owned U.S. patent application Ser. No. 725,075 filed Apr. 19, 1985, the disclosure of which is herein incorporated by reference.

As described in U.S. patent application Ser. No. 725,075, the connector is used to electrically common or interconnect pairs of terminals arranged in a staggered grid on at least two intersecting centerline progressions. Connector stick 10 comprises a plurality of spaced-apart connector housings 12 having a continuous four-sided sidewall 14 extending between a bottom terminal receiving wall 16 and a top mating wall 18. Each housing 12 has an outside corner 20 formed between adjacent side and bottom walls 14, 16.

Figure 2:
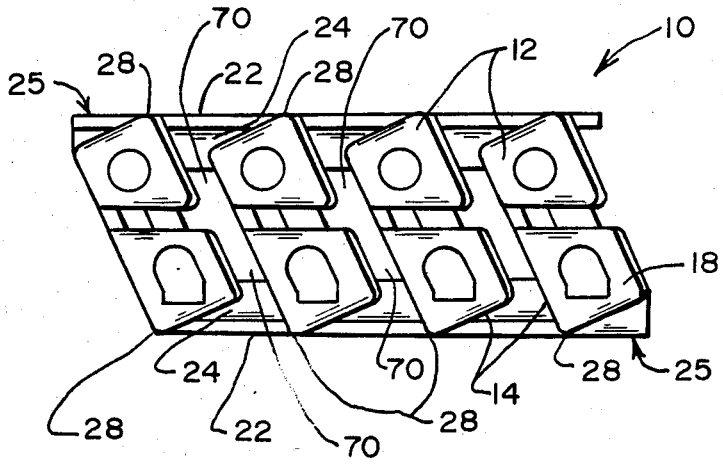
FIG. 2 is a plan view of the connector stick of FIG. 1.
Figure 8:
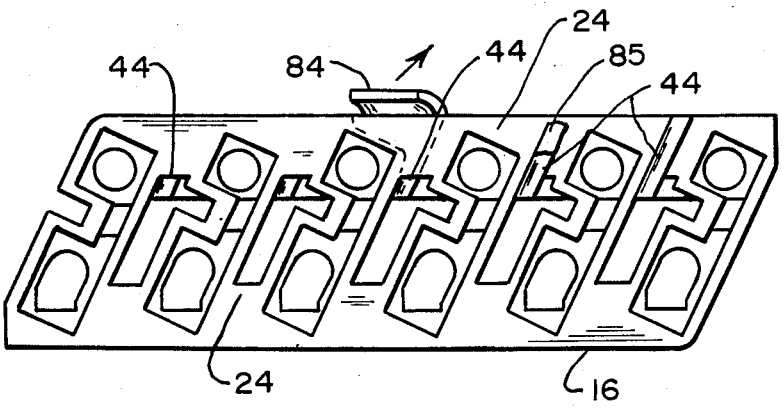

The side walls of each connector are integrally molded with a first strip-like carrier leg member 22, and the second walls 16 are integrally molded with a second strip-like carrier leg member 24. First and second carrier legs 22, 24 are joined at outside corner 20 to form a continuous carrier or channel 25 which is L-shaped in cross section. Carriers 22 are joined to sidewalls 14 at a radiused outside corner 28 thereof. As indicated in the plan view of FIG. 2, housings 16 are positioned at an angle to the lengths of carrier leg members 22, 24. The bottom view of FIG. 8 shows a pair of second carrier leg members 24 arranged in opposed relationship so as to overlie a substantial portion of the bottom terminal receiving end wall 16.

Both carriers 22, 24 provide the rigidity necessary when mating the formed connector with a pin array. Carrier 25 prevents bowing in a vertical plane caused by the insertion force of the mating operation. Carrier 24 prevents bowing in a horizontal plane. Both bowing actions would interfere with simultaneous alignment with all pins of a given pin array. The rigidity offered by the carrier members is especially important for larger connector sticks, of up to 24 circuits in length. The connector stick 10 comprises an integrally molded assembly of housings 12, and carrier leg members 22, 24. According to the present invention, methods and apparatus are providing for severing stick 10 into a plurality of connector modules having any predetermined number of housings 16 as may be desired. As is known in the art, an economy of manufacutre can be realized by mass inserting terminals within the housings of a given connector stick. A connector stick can be conveniently formed and shipped to an end user until required for installation in an electronic assembly. Thereupon, the methods and apparatus of the present invention can be employed to separate the connector stick in any desired circuit configuration. For example, the entire stick of 12 connectors can remain joined together for use in electrically commoning 12 pairs of electrical terminals.

However, if only four pairs of terminals need be electrically commoned, for example, the connector stick can be separated to conveniently form three such connector arrangements. The connector stick contemplated by the present invention is intended for use in high density closely spaced terminals arrangements. Accordingly, the connectors are provided with smooth four-sided walls 14 with smooth radiused corners 28 to allow close spacing of adjacent housings in any given angular orientation that may be required. It is important therefore that when sticks are severed into plural connector assemblies, that the smooth surfaces of walls 14 and the smooth corners 28 be preserved. Further, to provide further economy of manufacture, the methods and apparatus of the present invention provide fully automatic connector handling capability.

Figure 3:
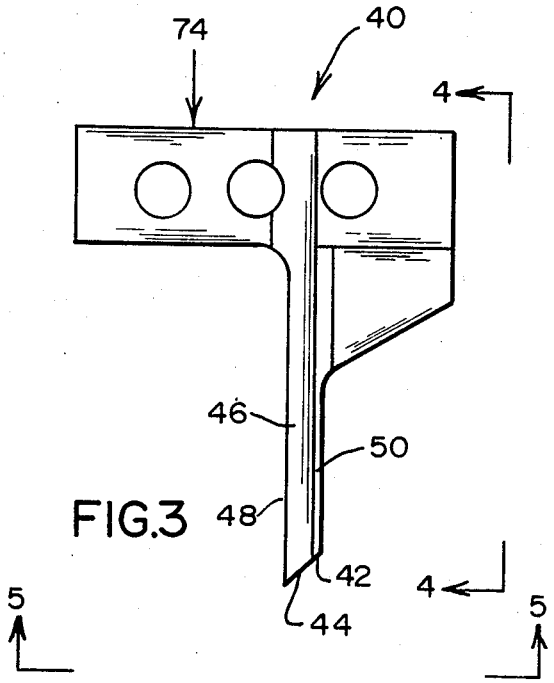
FIG. 3 is a front view of a tool for separating the connector stick of FIGS. 1 and 2.
Figure 4:
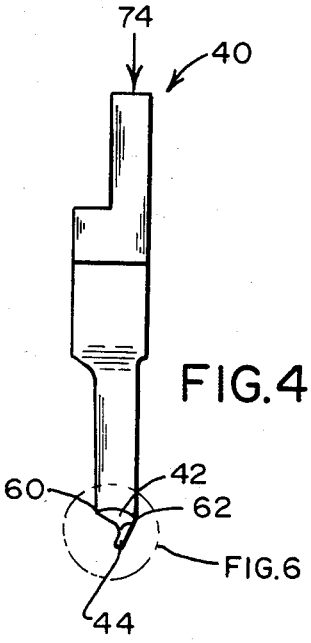
FIG. 4 is a side veiw of the tool of FIG. 3 taken along lines 4—4.
Figure 5:
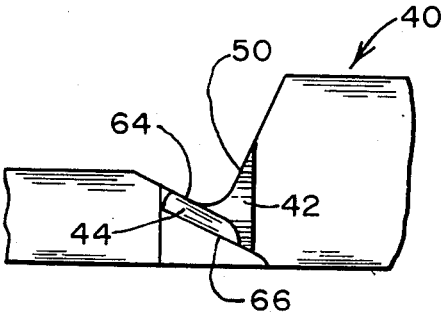
FIG. 5 is an end view taken along the lines 5—5 of FIG. 3.
Figure 6:
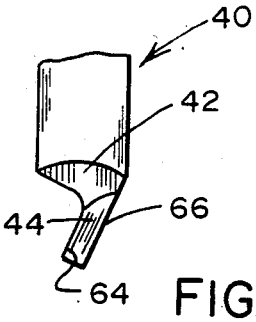
FIG. 6 shows a portion of the tool of FIGS. 3–5 in greater detail.

A common problem frequently encountered in severing connector sticks occurs when housing portions severed from the connector stick lodge in the automatic tooling, jamming or otherwise impairing the automatic tooling operation. With reference now to FIG. 3, a tool bit 40 according to the present invention is provided with first and second cutting surfaces 42, 44 at the free end of rail-like guide means 46. In cross section, rail 46 comprises a generally V-shaped channel, having first and second leg portions 48, 50. Leg portion 50 is ground to form a first cutting surface 42 at its free end, and leg portion 48 is ground to have a separate differently configured cutting surface 44. As can be seen in FIGS. 4–6, the two cutting surfaces 42, 44 present differently configured cutting edges. First cutting surface 42 is a generally concave circular-wedge-shaped surface, with two opposed cutting corners 60, 62 at the ends of its opposed straight-line edges. The second cutting surface is an elongated generally trough-shaped member, also concave, having two outwardly extending edges 64, 66 along its opposed elongated edges. First surface 42 is relieved, whereas the second surface is hollow ground, to control the severed housing material.

Figure 7:
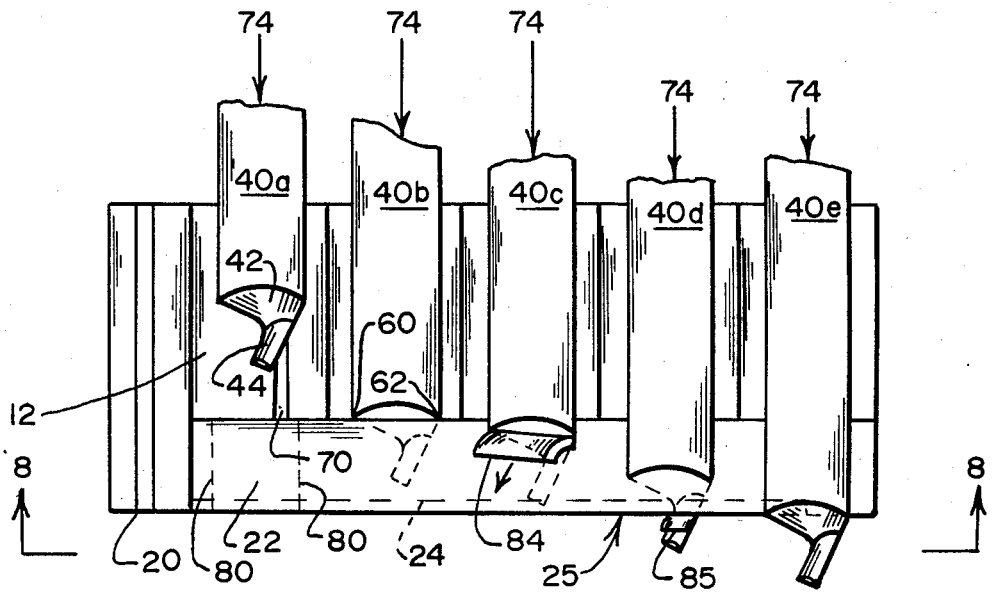
FIGS. 7 and 8 show a sequence for separating the connector stick of FIGS. 1 and 2.

As indicated in FIGS. 7 and 8, when fitted to connector stick 10, leg 48 is received between the recesses 70 formed between adjacent housings 12. Leg 48 then is guided between adjacent housings 12, to align rail 46 with stick 10. A conventional press, not shown in the figures, exerts a downward force on tool bit 40 in the direction of arrow 74 to drive first and second cutting surfaces 42, 44 toward first and second carrier leg members 22, 24.

FIGS. 7 and 8 show a plurality of tool bits 40 at various stages during the severing of carrier leg members 22, 24. In practice, all tool bits to be employed in a given connector stick would be maintained at the same relative distance form the carrier members 25, the progression of the various tool bits of FIGS. 7 and 8 being shown for illustrative purposes.

FIG. 7 shows from left to right, a continuing advancement of tool bit 40 toward the carrier leg members 22, 24. The first tool bit 40*a* is shown just having entered a first recess 70. Its neighboring tool bit 40*b* is shown with its first cutting surface 42 initially engaging the first carrier leg 22. The dotted lines 80 indicate the path of travel of the cutting edges 60, 62 (of the first cutting surface 42) through the first carrier leg 22. The third tool bit 40*c* is shown cutting a portion of first carrier leg 22, at the edge thereof remote from outside corner 20. At this point in time, the second cutting surface 44 has not yet engaged the second carrier leg 24. The cutting of surface 42 against first carrier leg 22 generates a curl-shaped chip 84 which is deflected in an outward direction away from connector stick 10.

At a point between the sequence of operation indicated by tool bits 40*c*, 40*d*, the second cutting surface 44 engages the second carrier leg 24, with cutting edges 64, 66 thereof severing a curl-shaped chip 85 of second carrier leg 24. At a point in the sequence of operation between that indicated by tool bits 40*c*, 40*d*, the second cutting surface 44 engages second carrier leg 24 to initiate severing thereof. A curl-shaped chip 85, is severed from second carrier leg 24, as the tool bit is lowered into connector stick 10. Thereafter, both cutting surfaces 42, 44 simultaneously cut into carrier legs 22, 24 until the cut portions meet at outside corner 20, thereby completely severing two adjacent connector housings 12 (see tool bit 40*e*).

Owing to the configuration of tool bit 40, and the relative orientation between tool bit 40 and connector stick 10, the smooth surface of sidewall 14, and especially the smooth radiused corner 28, is extended into the area originally occupied by carrier leg 22. Otherwise stated, the first carrier leg 22 is severed from housing sidewall 14 to extend the smooth rounded corner 28 into that area where sidewall 14 was originally joined to first carrier leg 22.

I claim:

1. Means for severing a rigid integrally molded dielectric connector stick including a plurality of spaced-apart housings joined together by at least one L-shaped carrier member having first and second legs joined at a corner thereof, the housing including adjacent side and bottom walls forming an outside corner, the first and second legs of the carrier member joining the respective side and bottom walls of adjacent housings together at said outside corners, and tool-receiving recesses formed between adjacent housings, said severing means comprising:

a tool bit having first and second cutting surfaces slidingly receivable in said recesses and adapted to sever said first and second legs of said carrier member, respectively; and means for advancing said tool bit cutting surfaces towards said carrier legs, whereby, upon advancement of the tool bit towards said carrier legs, said first carrier leg is first severed at points remote from said corner, and both said first and second carrier legs are thereafter simultaneously severed until they are removed from between adjacent housings.

2. The severing means of claim 1 wherein said tool bit further comprises generally V-shaped rail-like guide means with first and second sidewalls of the V-shape extending from said first and second cutting surfaces, and said second sidewall receivable between adjacent housings to maintain alignment between said tool bit and said carrier legs during severing.

3. The severing means of claim 2 wherein said housing has a smooth rounded corner from which said first carrier leg extends and said first and second cutting surfaces are joined together to form a complementary-shaped rounded cutting surface for providing a continuous extension of said corner.

4. The severing means of claim 2 wherein said first cutting surface comprises a concave circular-wedge shape with two contiguous straight edges and the second cutting surface comprises an elongated generally trough-shaped concave member extending from one of said straight edges.

* * * * *